US009968500B1

(12) United States Patent
Amini et al.

(10) Patent No.: US 9,968,500 B1
(45) Date of Patent: May 15, 2018

(54) SIMPLIFIED PATIENT TRANSFER SYSTEM

(71) Applicants: Afshin Amini, Shiraz (IR); Aziz Allah Vakili, Shiraz (IR); Monsour Farokhnia, Shiraz (IR)

(72) Inventors: Afshin Amini, Shiraz (IR); Aziz Allah Vakili, Shiraz (IR); Monsour Farokhnia, Shiraz (IR)

( * ) Notice: Subject to any disclaimer, the term of this patent is extended or adjusted under 35 U.S.C. 154(b) by 0 days. days.

(21) Appl. No.: 15/343,063

(22) Filed: Nov. 3, 2016

Related U.S. Application Data

(60) Provisional application No. 62/376,021, filed on Aug. 17, 2016.

(51) Int. Cl.
*A61G 7/10* (2006.01)
*A61G 7/00* (2006.01)

(52) U.S. Cl.
CPC ..... *A61G 7/1026* (2013.01); *A61G 7/1076* (2013.01); *A61G 7/1025* (2013.01)

(58) Field of Classification Search
CPC ... A61G 7/1025; A61G 7/1026; A61G 7/1032
USPC ..... 5/81.1 HS, 81.1 T, 81.1 R, 88.1
See application file for complete search history.

(56) References Cited

U.S. PATENT DOCUMENTS 2,665,432 A * 1/1954 Butler ..... A61G 7/1026 5/88.1
4,747,170 A * 5/1988 Knouse ..... A61G 7/1026 24/460
4,868,938 A * 9/1989 Knouse ..... A61G 7/1026 5/88.1
5,737,781 A * 4/1998 Votel ..... A61G 7/1015 24/265 EC
5,890,238 A * 4/1999 Votel ..... A61G 7/1015 24/265 EC
6,341,393 B1 * 1/2002 Votel ..... A61G 7/1019 5/484
6,378,148 B1 * 4/2002 Votel ..... A61G 7/1015 5/81.1 HS
6,496,991 B1 * 12/2002 Votel ..... A61G 7/1026 5/81.1 HS
6,728,979 B1 * 5/2004 Robert ..... A61G 7/103 5/81.1 HS
6,772,456 B2 * 8/2004 Votel ..... A61G 7/1019 5/81.1 HS
6,834,402 B2 * 12/2004 Hanson ..... A61G 7/1026 180/209
6,874,176 B2 * 4/2005 Berge ..... A61G 7/05707 5/627

(Continued)

*Primary Examiner* — Robert G Santos
(74) *Attorney, Agent, or Firm* — Richard G. Eldredge; Eldredge Law Firm

(57) ABSTRACT

A patient transfer system includes a first bed; a second bed; a patient; a sheet having a channel; a bar; a support; means of rotation; and a belt; wherein the patient is reclined on the sheet on the first bed which is positioned next to the second bed; wherein the sheet is configured with a channel that runs along the edge of the sheet so that the bar nest in the channel; wherein the support is in removable communication with the second bed and fixed communication with the rotation device; wherein the rotation device is in removable communication with the bar so that when activated the rotation device pulls on the belt and bar causing the patient to be transferred from the first bed to the second.

3 Claims, 3 Drawing Sheets

(56) References Cited

U.S. PATENT DOCUMENTS 7,114,203 B2 * 10/2006 Lloyd ..... A61G 7/1026 5/81.1 HS
7,337,477 B2 * 3/2008 Scordato ..... A61G 7/1032 5/81.1 HS
7,458,113 B2 * 12/2008 Milam ..... A61G 7/1026 254/329
7,506,387 B1 * 3/2009 Scordato ..... A61G 7/1026 5/81.1 HS
7,571,498 B2 * 8/2009 Jewell ..... A61G 7/1026 5/81.1 HS
8,640,288 B2 * 2/2014 Jensen ..... A61G 1/01 5/625
8,959,682 B2 * 2/2015 Jenson ..... A61G 1/01 5/487
9,173,791 B2 * 11/2015 Jensen ..... A61G 1/013
9,320,667 B2 * 4/2016 Tilk ..... A61G 7/1026
9,439,823 B2 * 9/2016 Tilk ..... A61G 7/1026
9,445,963 B2 * 9/2016 Tilk ..... A61G 7/1026
9,675,509 B2 * 6/2017 Tilk ..... A61G 7/1026
2002/0029418 A1 * 3/2002 Votel ..... A61G 7/1019 5/81.1 RP
2003/0074732 A1 * 4/2003 Hanson ..... A61G 7/1026 5/81.1 R
2004/0123382 A1 * 7/2004 Berge ..... A61G 7/05707 5/81.1 HS
2004/0221388 A1 * 11/2004 Votel ..... A61G 7/1015 5/81.1 HS
2005/0150045 A1 * 7/2005 Lloyd ..... A61G 7/1026 5/81.1 HS
2006/0273292 A1 * 12/2006 Milam ..... A61G 7/1026 254/343
2007/0056095 A1 * 3/2007 Scordato ..... A61G 7/1032 5/81.1 R
2009/0178193 A1 * 7/2009 Jewell ..... A61G 7/1026 5/81.1 HS
2010/0011506 A1 * 1/2010 Jensen ..... A61G 1/01 5/627
2010/0199435 A1 * 8/2010 Jensen ..... A61G 1/013 5/628
2014/0123393 A1 * 5/2014 Jenson ..... A61G 1/01 5/625
2016/0089288 A1 * 3/2016 Tilk ..... A61G 7/1026 5/81.1 HS
2016/0089289 A1 * 3/2016 Tilk ..... A61G 7/1026 5/81.1 HS
2016/0089290 A1 * 3/2016 Tilk ..... A61G 7/1026 5/81.1 T
2016/0089291 A1 * 3/2016 Tilk ..... A61G 7/1026 5/81.1 HS

* cited by examiner

SIMPLIFIED PATIENT TRANSFER SYSTEM

BACKGROUND

1. Field of the Invention

The present invention relates generally to patient care systems, and more specifically, to a patient transfer system for relocating a patient from one bed to another.

2. Description of Related Art

Patient care systems are well known in the art and are effective means to provide for the needs of people who are injured or ill. For example, FIG. 1 depicts a conventional patient transfer system 101 having a patient 103, a first bed 105, a second bed 107, a sheet 109 and two lifters 111, 113. During use, the patient lays on sheet 109 on the first bed 105, lifters 111 and 113 pick up the patient 103 via sheet 109 and quickly move them to the second bed 107 as depicted by motion A.

One of the problems commonly associated with system 101 is it limited efficiency. For example, it is very difficult if not impossible for one lifter 111, 113 to accomplish the patient 103 transfer by themselves. Additionally the patient 103 is jostled about and feels the impact of the transfer.

Accordingly, although great strides have been made in the area of patient transfer systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
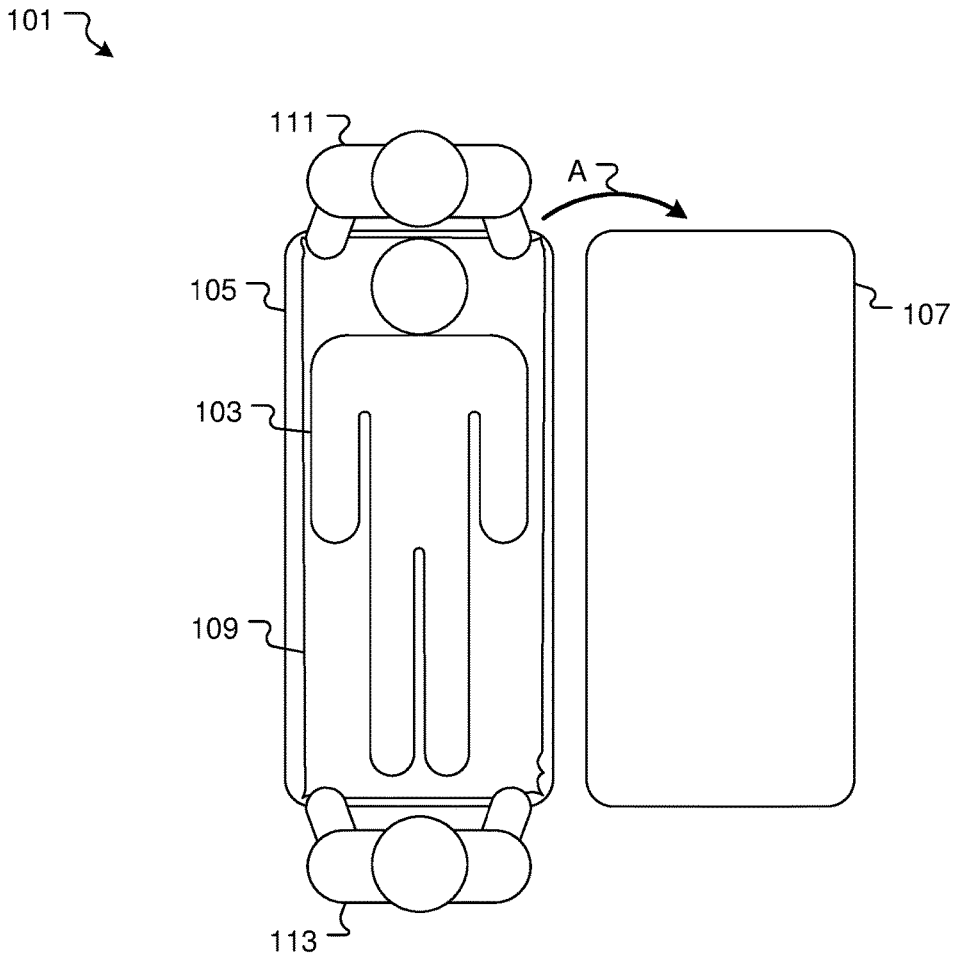
FIG. 1 (Prior Art)
FIG. 1 is a top view of a common patient transfer system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional patient transfer systems. Specifically, the system of the present application enables a single user to transfer a patient from one bed to another. In addition, the transfer as experienced by the patient is smooth. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2A:
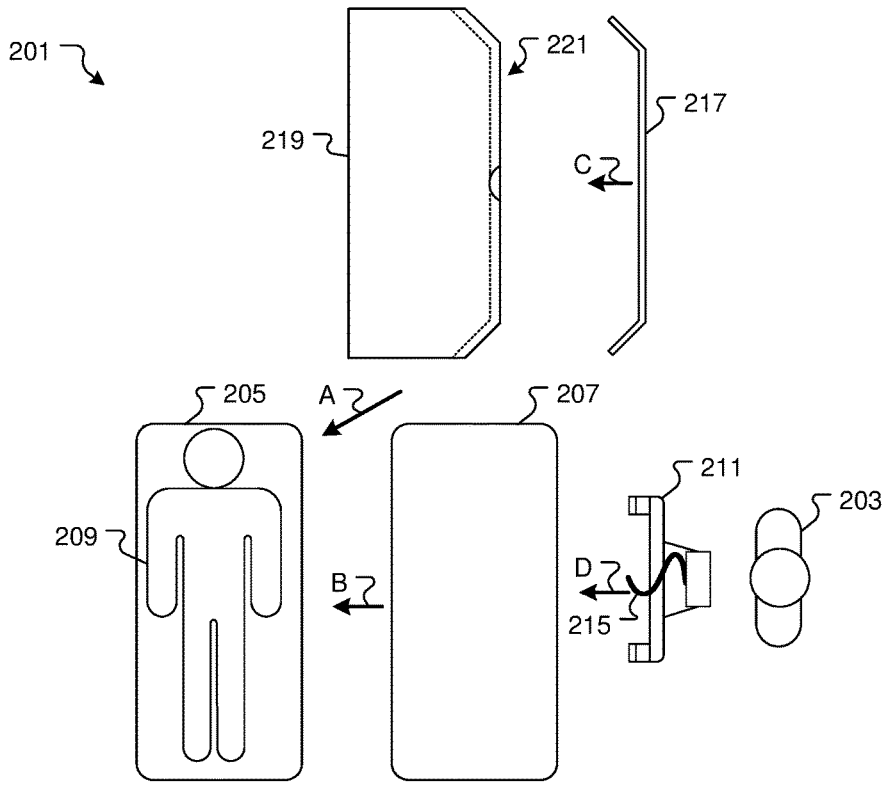
FIGS. 2A, 2B and 2C are top views of a simplified patient transfer system in accordance with a preferred embodiment of the present application at various stages of use.
Figure 2B:
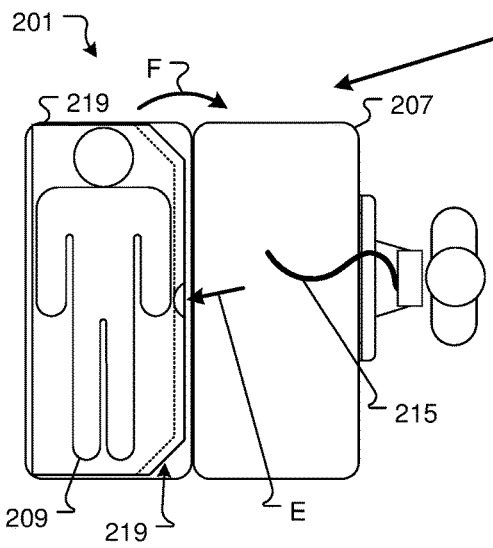
Figure 2C:
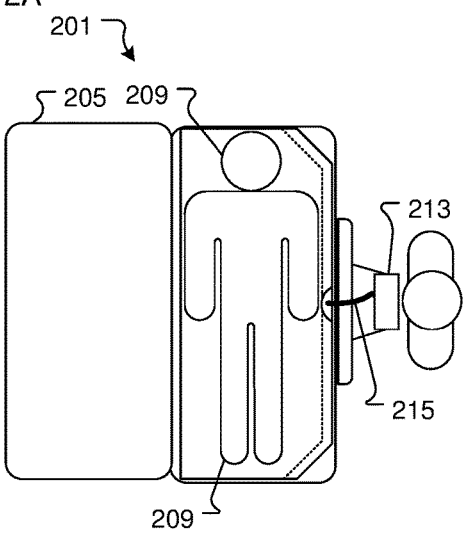

Referring now to the drawings wherein like reference characters identify corresponding or similar elements throughout the several views, FIGS. 2A, 2B and 2C depict top views of a simplified patient transfer system in accordance with a preferred embodiment of the present application. It will be appreciated that system 201 overcomes one or more of the above-listed problems commonly associated with conventional patient transfer systems.

In the contemplated embodiment, system 201 comprises a user 203, a first bed 205, one or more second beds 207, one or more patients 209, one or more supports 211 in communication with one or more means of rotation 213, one or more belts 215, one or more bars 217 and one or more sheets 219 having one or more channels 221. In use sheet 219 is placed between patient 209 and the first bed 205 as depicted by motion A, second bed 207 is brought to proximity with the first bed 205 as depicted by motion B, bar 217 is placed in channel 221 as depicted by motion C, support 211 is secured to second bed 207 as depicted by motion D and belt 215 is secured to bar 217 as depicted by motion E, user 203 then activates means of rotation 213 which causes belt 215 to retract as depicted by motion F and pulls patient 209 from the first bed 205 to second bed 207 as depicted by motion G.

It should be appreciated that one of the unique features believed characteristic of the present application is bar 217, channel 221 and means of rotation 213 that enable a single user 203 to efficiently transfer patient 209 from one bed 205 to another 207. In the current embodiment channel 221 is created by rolling sheet 219 around bar 217, it will be appreciated that in this manner any bed sheet could be used as sheet 219. It will also be appreciated that channel 221 could be of any fashion as long as it is capable of holding bar

217. It will also be appreciated that bar 217 could take on any form or construction without deviating from the intent of this disclosure. It will also be appreciated that channel 221 could be of any fashion as long as it is capable of holding bar 217. It is contemplated and will be appreciated that means of rotation 213 could be mechanized or hand operated. It is contemplated that a control means for a mechanized means of rotation 213 would be both beneficial and obvious.

Figure 3:
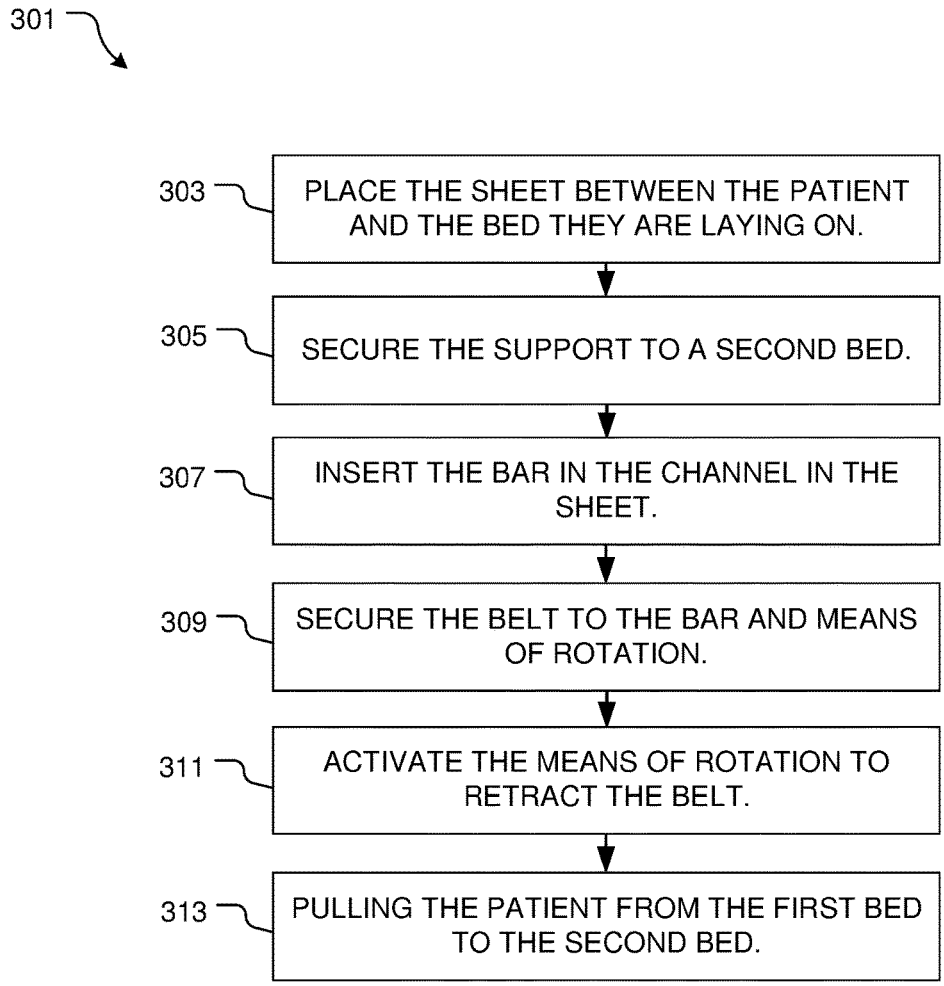
FIG. 3 is a diagram of the preferred method of use of the system of FIGS. 2A, 2B and 2C.

Referring now to FIG. 3 the preferred method of use of system 201 is depicted, method 301 comprising placing the sheet between the patient and the bed they are laying on 303, securing the support to a second bed 305, inserting the bar in the channel in the sheet 307, securing the belt to the bar and means of rotation 309, activating the means of rotation to retract the belt 311, pulling the patient from the first bed to the second bed 313.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed:

1. A patient transfer system for transferring a patient from a first bed to a second bed, the system comprising;

a sheet having a sewn in channel extending from a first end to a second opposing end of the sheet and positioned near a side edge of the sheet;

a bar configured to be inserted into the sewn in channel, the bar extending an entire length of the sheet and configured to removably slide within the channel;

a support structure having a top and two arms extending outwardly and configured to secure on an underneath side of the second bed to hold the support structure in place, the support structure is removably attached to the second bed;

a means of rotation secured to the top of the support structure; and a belt rotatably attached to the means of rotation and configured to releasably engage with the bar;

wherein when activated, the means of rotation pulls on the belt and the bar, which in turn causes the sheet to transfer to the second bed, which in turn causes the patient to be transferred from the first bed to the second bed via the sheet.

2. The system of claim 1, wherein the means of rotation is a hand crank.

3. The system of claim 1, wherein the means of rotation is a mechanical crank.

* * * * *